US005310182A

United States Patent [19]

Macknigg

[11] Patent Number: 5,310,182

[45] Date of Patent: May 10, 1994

[54] STRING ADJUSTMENT DEVICE FOR BALL RACKETS, FOR EXAMPLE TENNIS RACKETS

[76] Inventor: Johann Macknigg, Anichgasse 32, Graz, Austria, A-8051

[21] Appl. No.: 70,363

[22] PCT Filed: Oct. 10, 1991

[86] PCT No.: PCT/AT91/00109

§ 371 Date: Jul. 30, 1993

§ 102(e) Date: Jul. 30, 1993

[87] PCT Pub. No.: WO92/10243

PCT Pub. Date: Jun. 25, 1992

[30] Foreign Application Priority Data

Dec. 7, 1990 [AT] Austria ..... A2478/90

[51] Int. Cl.[5] ..... A63B 69/38

[52] U.S. Cl. ..... 273/73 R

[58] Field of Search ..... 273/73 R, 73 A, 73 B, 273/73 D

[56] References Cited

U.S. PATENT DOCUMENTS

| | | | |
|---|---|---|---|
| 4,089,523 | 5/1978 | Newburger et al. | 273/73 R |
| 4,776,591 | 10/1988 | Ho | 273/73 D X |
| 4,989,864 | 2/1991 | Ubl | 273/730 |
| 5,035,429 | 7/1991 | Redrow | 273/73 A X |
| 5,207,423 | 5/1993 | Short | 273/73 R |

FOREIGN PATENT DOCUMENTS

| | | | |
|---|---|---|---|
| 2661102 | 10/1991 | France | 273/73 D |
| 9210243 | 6/1992 | World Int. Prop. O. | 273/73 D |

*Primary Examiner*—William E. Stoll

*Attorney, Agent, or Firm*—Heslin & Rothenberg

[57] ABSTRACT

A string adjuster for ball rackets has a support member (1) in which recesses (2) are provided. In the recesses (2) carrier bodies (3), that are preferably roller-shaped, are bearingly supported for rotation around an axis (5), engagement bodies (4) protruding from the circumference of the carrier bodies (3). These engagement bodies (4) are formed such that the strings (8) are shifted into their correct position when the engagement bodies are inserted into the meshes (7) of the strings (FIG. 1).

11 Claims, 2 Drawing Sheets

STRING ADJUSTMENT DEVICE FOR BALL RACKETS, FOR EXAMPLE TENNIS RACKETS

The invention relates to a string adjustment device for ball rackets, for example tennis rackets, comprising a carrier body provided with protruding engagement bodies which can be inserted matching into the meshes of the strings so that when the engagement bodies are inserted into the meshes, the strings are displaced into their correct position.

It is known that the strings of ball rackets are often displaced by the impact of the balls. Thereby for example during the stroke the direction in which the ball is thrown off is changed so that faults are caused. It is necessary therefore to replace the displaced strings into their correct position. This can be done by hand. However, such a procedure is troublesome and, over all, an exact alignment of the strings cannot be ensured thereby.

Therefore, adjustment devices for the strings of ball rackets have been already proposed (DE-OS 33 37 341, DE-GM 85 14 020). These known string adjusters consist of a plate-shaped carrier body from which tooth-shaped engagement bodies protrude. These engagement bodies are inserted into the meshes confined by the individual strings, whereby the displaced strings are replaced into the correct position.

The DE-OS 33 37 341 suggests to mount the plate-shaped carrier body either permanently at the court or clubhouse or to form it as a component of the racket covering. However, then it is not possible to use this string adjuster during the game without leaving the court or at least without a longer interruption of the game. Even if such a string adjuster is provided, the player must replace the displaced strings during the game by hand into their correct position.

The DE GM 85 14 020 certainly shows a comb-like string adjuster which due to its small dimensions can be put also in a garment's pocket and, therefore, can be used also during the game without a longer interruption thereof, however with this known string adjuster only a comparatively small number of meshes of the strings can be adjusted into the correct position in one single operation step. Therefore, it is necessary in the most cases to introduce this known string adjuster several times one after another into different meshes of the strings in order to obtain an alignment of all strings in correct position. This procedure is troublesome and time-consuming.

The present invention has at its object to provide for a string adjuster for ball rackets which on the one hand is small in its dimensions so that it can be put into a garment's pocket and therefore can be taken along during the game and can be used quickly, and on the other hand ensures a quick adjustment of all chords of the strings of a ball racket into the correct position. In order to solve this task, the invention suggests that a circulating carrier body is provided that is bearingly supported in a support member.

The dimensions of such a string adjuster can be kept small so that this string adjuster can be taken along during the game without any difficulty and, therefore, is quickly at hand so that it can be used also in short intervals of the game, for example before the service of the opponent. Nevertheless, with such a string adjuster the displaced strings of a ball racket can be brought into their correct position in a very short time, because it is only necessary to put the carrier body so onto the strings of the racket that a row of the protruding engagement bodies engages in a mesh and then to roll the carrier body along the strings so that thereby the carrier body is circulated and the engagement bodies protruding from the carrier body engage one after the other the neighbouring meshes and adjust the strings confining these meshes into the correct position.

Within a simple embodiment of the invention, the carrier body consists of a roller bearingly supported for rotation in the support member, the engagement bodies protruding from the periphery of this roller. Such a string adjuster can be manufactured very easily. In the simplest case the roller can be bearingly supported in a bow provided with a handle, thus being formed similar to a pressure roller for wallpaper, the engagement bodies protruding from said roller.

According to a preferred embodiment of the invention, however, the roller is accommodated in a recess in the support member that is open to the side, the engagement bodies protruding from the recess. Thus, the roller is so accommodated that it is protected and a simple and reliable rotational bearing of the roller is enabled on the walls of the support member that confine the recess and neighbour the rotational axis. A simple operation can be obtained if the recess is positioned in the region of an edge of the support member.

Suitably, the support member is so formed that it can be easily grasped and held by the hand.

Occasionally, the distances between the longitudinal strings and the transverse strings are different. In order to enable one also with such ball rackets to replace all strings by the inventive string adjuster into their correct position, according to a further feature of the invention two rollers having engagement bodies protruding from the circumference are bearingly supported for rotation in the support member, which rollers preferably are disposed at sides of the support member opposing each other. The engagement bodies protruding from the two rollers have then such dimensions and distances from each other that when moving the one roller in direction of the longitudinal strings these longitudinal strings can be brought into their correct position, and by movement of the other roller in direction of the transverse strings these transverse strings. The disposal of the two rollers at opposing sides of the support member ensures a simple accommodation of these rollers on the same support member.

Frequently, the distances of the strings of different ball rackets are different from each other. In order to adapt the inventive string adjuster to such different kinds of ball rackets, the rollers are suitably exchangeably disposed in the support member. Within such an embodiment, for another type of ball rackets only the rollers must be exchanged against other rollers that correspond to the type.

In order to allow a simple exchange of the rollers, these are suitably provided with shaft ends protruding on the front side, which shaft ends are inserted into slots provided in the side walls of the support member and being open at the edge.

Within another embodiment of the inventive string adjuster, the carrier body consists of a circulating band that is guided over rollers disposed in the support member and preferably bearingly supported for rotation, this band carrying on its outside the protruding engagement bodies. This band guided over the rollers can be set in circulating motion like the rollers so that the engagement bodies protruding from the band engage one after the other the meshes of the strings and thereby align the chords.

In order to avoid a slip of the band on the rollers bearingly supported for rotation, the band can be formed at least partially as a toothed belt, the teeth of which mesh with teeth provided on circumference of the rollers. It is not necessary hereby to form the entire band as a toothed belt, for example only the two longitudinal edges of the band may be provided with teeth and only the circumferential sections neighbouring the front sides of the rollers may be provided with teeth.

In order to avoid a sagging of the band when this is moved over the strings of the racket and in order to ensure a complete engagement of the engagement bodies into the meshes of the strings, it is of advantage if the band between the two rollers over which it is guided, is abutted on its side not facing the engagement bodies on an abutment plate provided in the support member.

In order to ensure an exact alignment of the strings, the engagement bodies according to the invention have the shape of a pyramid having a rectangular basis that corresponds to the also rectangular shaped meshes. The tip of the pyramid enters slightly into these meshes, the pyramid surfaces ensure an engagement of the strings over the entire length that confines the respective mesh.

In the drawing the invention is schematically explained by way of exemplative embodiments.

Figure 1:
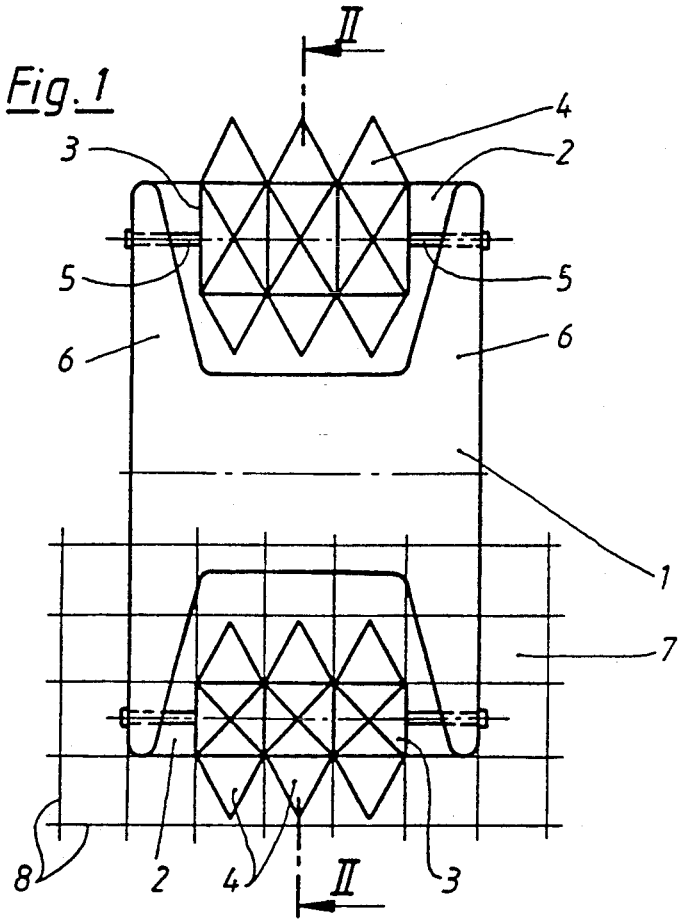
FIG. 1 shows a side view of a first embodiment of the inventive string adjuster for ball rackets in direction of the arrow I in FIG. 2
Figure 2:
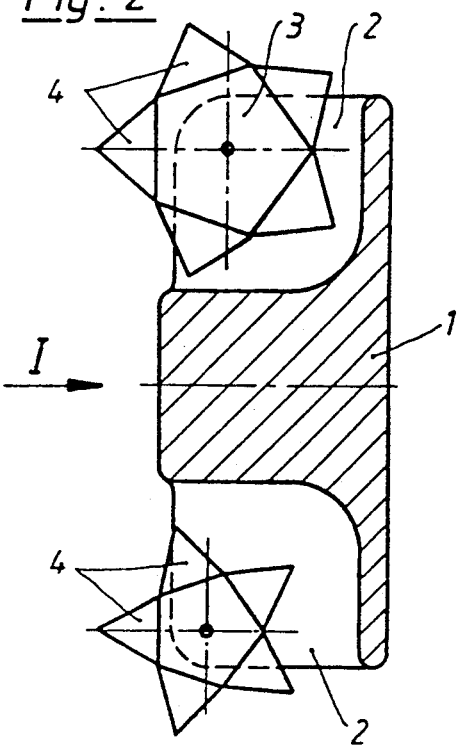
FIG. 2 is a section through the string adjuster along the line II—II in FIG. 1.
Figure 3:
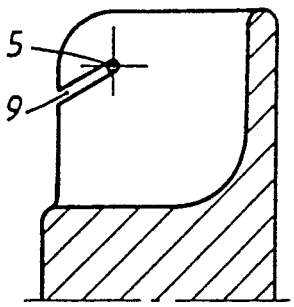
FIG. 3 shows a partial section similar to that in FIG. 2, however the roller with the protruding engagement bodies being omitted so that the bearing of the roller can be seen.

The embodiment of the inventive string adjuster shown in FIGS. 1 to 3 comprises a support member 1 having such dimensions that it can easily be grasped by hand and can also be accommodated in the pocket of a clothing article. On two opposing sides of the support member 1 there are recesses 2 which are so disposed along one edge of the support member 1 that they are open on two surfaces of the support member 1 that intersect along this edge.

In each one of these recesses 2 there is disposed a roller 3, from the circumference of which engagement bodies 4 protrude. The engagement bodies 4 have the shape of a pyramid with a rectangular basis that is connected to the main portion of the roller. The rollers 3 are bearingly supported in the side walls 6 confining the recesses 2 by means of shaft ends 5. This bearing is made such that the rollers 3 can easily be removed from the recesses 2 of the support member 1 and can be replaced by other rollers or, respectively, by rollers with engagement bodies 4 having other dimensions. For this, for example, at least that shaft end 5 that is provided on one side of the roller 3 may be shiftably supported in the roller 3 or in the side walls 6. However, as this can be seen from FIG. 3, the shaft ends 5 may also be rigidly connected to the roller 3, preferably the shaft ends may form one single piece with the roller 3 and may be inserted into slots 9 provided in the side walls 6 of the support member and being open to the edge. At this, the slots 9 are so disposed that the shaft ends 5 are pressed towards the bottom of the slots by the pressure exerted onto the roller 3 during its movement along the strings, however, that nevertheless the shaft ends 5 can easily be guided out of the slots 9 for replacement of the roller 3.

Figure 4:
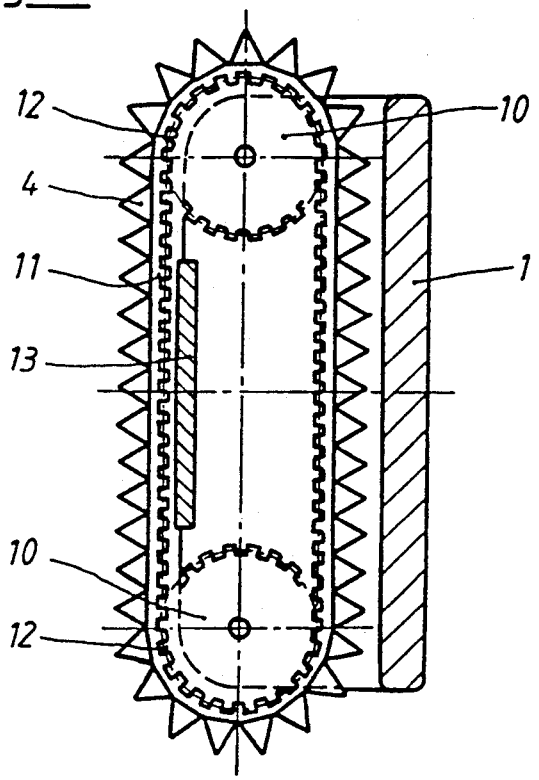
FIG. 4 shows a longitudinal section through a second embodiment of the inventive string adjuster and FIG. 5 shows a longitudinal section through a third embodiment of the inventive string adjuster.

Within the embodiment according to FIG. 4 two rollers 10 are bearingly supported in the support member 1, a band 11 forming the carrier body and carrying the protruding engagement bodies 4 being guided over the rollers. Suitably, the rollers 10 are provided with teeth 12 at least in the two sections neighbouring the front sides, and the band 11 is formed as a toothed belt meshing with the teeth 12 of the rollers on its bottom side in these regions. Thereby, a slippage between the rollers 10 and the band 11 is avoided. On its side not facing the engagement bodies 4, the band 11 is supported between two rollers 10 on a support plate 13 that is fixed to the support member 1 so that the band does not deflect when it is moved along the strings of the racket.

Figure 5:
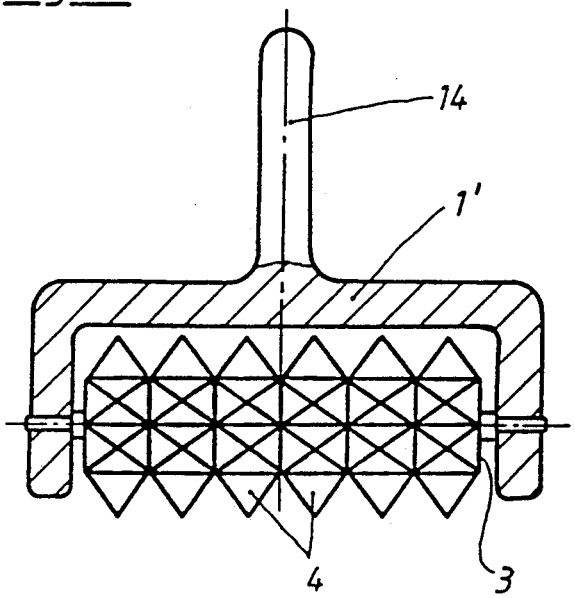

Within the particular simple embodiment shown in FIG. 5, a roller 3, from the circumference of which the engagement bodies 4 protrude, is bearingly supported in a support member 1' formed by a bow and provided with a handle 14.

When the inventive string adjuster is in use, the engagement bodies within each embodiment engage the meshes 7 indicated in FIG. 1 and constituted by the longitudinal and transversal strings 8 of a ball racket. If the roller 3 rolls over the strings 8 or, respectively, if the band 11 is circulated along the strings 8, one after the other of the engagement bodies 4 enter the different meshes 7, whereby the strings are aligned.

The roller 3, the band 11 and the engagement bodies 4 that preferably are formed in a single piece with the roller 3 or, respectively, with the band 11, may consist of synthetic plastics material, in particular of rigid PVC or of hard rubber.

I claim:

1. String adjuster for ball rackets, for example tennis rackets, comprising at least one carrier body (3,11) provided with protruding engagement bodies (4) which can be inserted into matching meshes (7) of strings so that when the engagement bodies are inserted into the meshes (7), a set of strings (8) is displaced into the correct position, characterized in that a circulating carrier body (3,11) is provided that is bearingly supported in a support member (1).

2. String adjuster according to claim 1, characterized in that the carrier body consists of a roller (3) bearingly supported for rotation in the support member (1), the engagement bodies (4) protruding from the circumference of this roller.

3. String adjuster according to claim 2, characterized in that the roller is accommodated in a recess (2) in the support member (1) that is open to the side, the engagement bodies (4) protruding from the recess.

4. String adjuster according to claim 3, characterized in that the recess (2) is positioned in the region of an edge of the support member (1).

5. String adjuster according to claim 1, characterized in that in the support member (1) two rollers (3) having engagement bodies (4) protruding from the circumference are bearingly supported for rotation, said rollers (3) being disposed preferably at sides of the support member (1) that oppose each other.

6. String adjuster according to claim 5, characterized in that the rollers (3) are exchangeably disposed in the support member (1).

7. String adjuster according to claim 5, characterized in that the rollers (3) are provided on their front sides with protruding shaft ends (5) that can be inserted into slots (9) that are provided in side walls (6) of the support member (1) and are open to the edge (FIG. 3).

8. String adjuster according to claim 1, characterized in that the carrier body consists of a circulating band (11) guided over rollers (10) that are disposed in the support member (1) and preferably are bearingly supported, said band carrying on its outside the protruding engagement bodies (4).

9. String adjuster according to claim 8, characterized in that the band (11) is at least partially formed as a toothed belt, the teeth of which mesh with teeth (12) provided on the circumference of the rollers (10).

10. String adjuster according to claim 8, characterized in that the band (11) is abutted between the two rollers (10) on the side not facing the engagement bodies (4) on a support plate (13) provided in the support member (1).

11. String adjuster according to claim 1, characterized in that the engagement bodies have the shape of a pyramid having a rectangular basis.

* * * * *